US011739943B2

(12) United States Patent
McEvoy

(10) Patent No.: US 11,739,943 B2
(45) **Date of Patent: *Aug. 29, 2023**

(54) TABLETOP COOKING ASSEMBLY

(71) Applicant: William B. McEvoy, Redford, MI (US)

(72) Inventor: William B. McEvoy, Redford, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/931,259

(22) Filed: Sep. 12, 2022

(65) Prior Publication Data

US 2023/0167979 A1 Jun. 1, 2023

Related U.S. Application Data

(63) Continuation of application No. 17/539,461, filed on Dec. 1, 2021, now Pat. No. 11,454,402.

(51) Int. Cl.

| | |
|---|---|
| ***F24C 15/08*** | (2006.01) |
| ***F24C 3/08*** | (2006.01) |
| ***F24C 3/02*** | (2021.01) |
| ***F24C 15/20*** | (2006.01) |

(52) U.S. Cl.

CPC ..... *F24C 15/08* (2013.01); *F24C 3/02* (2013.01); *F24C 3/08* (2013.01); *F24C 15/20* (2013.01)

(58) Field of Classification Search

CPC ..... F24C 15/2042
USPC ..... 126/25 R, 29, 299 D, 299 F
See application file for complete search history.

(56) References Cited

U.S. PATENT DOCUMENTS

| | | | |
|---|---|---|---|
| 60,453 | A | 12/1866 | Wilson |
| 1,562,346 | A | 11/1925 | Oster |
| 1,582,346 | A | 4/1926 | Oster |
| 2,347,334 | A | 4/1944 | Schmieg |
| 2,577,150 | A | 12/1951 | Pledger |
| 2,868,108 | A | 1/1959 | Petersen |
| 3,212,873 | A | 10/1965 | Richter et al. |
| 3,242,652 | A | 3/1966 | Malenchini |
| 3,299,620 | A | 1/1967 | Hollingworth |
| 3,412,530 | A | 11/1968 | Cardiff |
| 3,491,744 | A | 1/1970 | Von Kohorn, Jr. et al. |

(Continued)

FOREIGN PATENT DOCUMENTS

| | | |
|---|---|---|
| CN | 107997380 | 5/2018 |
| CN | 208446905 | 2/2019 |

(Continued)

*Primary Examiner* — Vivek K Shirsat
(74) *Attorney, Agent, or Firm* — Howard & Howard Attorneys PLLC

(57) ABSTRACT

A tabletop cooking assembly for preparing foods thereon includes a burner element, a pan surrounding the burner element, a grill adjacent to the burner element, and an exhaust plenum adjacent to the grill having a plurality of apertures for drawing smoke away from the grill and an outlet for exhausting smoke therefrom. The exhaust plenum forms a defined volume around the grill to draw the smoke into the exhaust plenum and away from the grill such that the smoke does not pass through the grill or about the burner element. An exhaust duct and at least one filter assembly having at least one filter disposed therein are in fluid communication with the exhaust plenum for filtering grease. The subject invention also includes a blower for exhausting the smoke from the exhaust duct to an area outside of and immediately adjacent to the tabletop cooking assembly.

15 Claims, 14 Drawing Sheets

(56) References Cited

U.S. PATENT DOCUMENTS

| | | | |
|---|---|---|---|
| 3,494,108 | A | 2/1970 | Moragne |
| 3,500,740 | A | 3/1970 | Aubrey |
| 3,513,766 | A | 5/1970 | Ahirich |
| 3,570,040 | A | 3/1971 | Kiyomi |
| 3,590,804 | A | 7/1971 | Welshofer et al. |
| 3,596,439 | A | 8/1971 | Moragne |
| 3,664,255 | A | 5/1972 | Kuechler |
| 3,785,124 | A | 1/1974 | Gaylord |
| 3,854,388 | A | 12/1974 | King |
| 3,880,061 | A | 4/1975 | Hensiek et al. |
| 3,891,548 | A | 6/1975 | Marcussen |
| 3,952,640 | A | 4/1976 | Kuechler |
| 4,070,670 | A | 1/1978 | Chen |
| 4,089,327 | A | 5/1978 | Welsh |
| RE29,837 | E | 11/1978 | Moore |
| 4,153,044 | A | 5/1979 | Nett |
| 4,201,186 | A | 5/1980 | Paquin |
| 4,248,162 | A | 2/1981 | Skeist |
| 4,250,870 | A | 2/1981 | Kuechler |
| 4,251,025 | A | 2/1981 | Bonne et al. |
| 4,266,528 | A | 5/1981 | Barnhart et al. |
| 4,284,421 | A | 8/1981 | Howard |
| 4,286,572 | A | 9/1981 | Searcy et al. |
| 4,346,692 | A | 8/1982 | McCauley |
| 4,350,504 | A | 9/1982 | Diachuk |
| 4,366,525 | A | 12/1982 | Baumgartner |
| 4,473,382 | A | 9/1984 | Cheslock |
| 4,506,655 | A | 3/1985 | Kuechler |
| 4,562,827 | A | 1/1986 | Cerola |
| 4,616,626 | A | 10/1986 | Kwan Soon |
| 4,655,194 | A | 4/1987 | Wooden |
| 4,846,146 | A | 7/1989 | Fucker et al. |
| 4,854,949 | A | 8/1989 | Giles, Sr. et al. |
| 4,884,949 | A | 12/1989 | Eakin |
| 4,898,089 | A | 2/1990 | Roos |
| 4,902,316 | A | 2/1990 | Giles, Sr. et al. |
| 4,934,337 | A | 6/1990 | Falk |
| 4,941,400 | A | 7/1990 | Moore |
| 4,962,694 | A | 10/1990 | Graver |
| 5,002,040 | A | 3/1991 | MacFarlane |
| 5,063,906 | A | 11/1991 | Rogers et al. |
| 5,069,197 | A | 12/1991 | Wisting |
| 5,154,161 | A | 10/1992 | Rogers et al. |
| 5,190,026 | A | 3/1993 | Doty |
| 5,205,279 | A | 4/1993 | Brown |
| 5,211,159 | A | 5/1993 | Lieblein et al. |
| 5,215,557 | A | 6/1993 | Johnson et al. |
| 5,235,150 | A | 8/1993 | Buske et al. |
| 5,251,608 | A | 10/1993 | Cote |
| 5,287,799 | A | 2/1994 | Pickering et al. |
| 5,325,842 | A | 7/1994 | Beach et al. |
| 5,419,239 | A | 5/1995 | Covington et al. |
| 5,441,279 | A | 8/1995 | Messina |
| 5,467,761 | A | 11/1995 | Kuechler |
| 5,547,339 | A | 8/1996 | Burgers |
| 5,577,490 | A | 11/1996 | Overton, Jr. |
| 5,704,955 | A | 1/1998 | Giles |
| 5,884,619 | A | 3/1999 | Terry |
| 5,925,172 | A | 7/1999 | Rick et al. |
| 5,941,235 | A | 8/1999 | Carter |
| 5,984,990 | A | 11/1999 | McDonald |
| 5,993,195 | A | 11/1999 | Thompson |
| 6,036,736 | A | 3/2000 | Wallace et al. |
| 6,041,772 | A | 3/2000 | Ward et al. |
| 6,041,774 | A | 3/2000 | Ward et al. |
| 6,050,258 | A | 4/2000 | Neitzel et al. |
| 6,142,142 | A | 11/2000 | Woodall, III et al. |
| 6,182,653 | B1 | 2/2001 | Otenbaker et al. |
| 6,230,701 | B1 | 5/2001 | Schultheis et al. |
| 6,241,809 | B1 | 6/2001 | Hopkins |
| 6,344,074 | B1 | 2/2002 | Ward et al. |
| 6,716,274 | B2 | 4/2004 | Gogins et al. |
| 6,772,753 | B2 | 8/2004 | Roesler et al. |
| 6,776,152 | B2 | 8/2004 | Lee |
| 6,837,152 | B1 | 1/2005 | Chiang |
| 6,849,100 | B2 | 2/2005 | Lim et al. |
| 6,962,621 | B2 | 11/2005 | Jung |
| 7,002,110 | B2 | 2/2006 | Satou et al. |
| 7,018,449 | B2 | 3/2006 | Fitch et al. |
| 7,041,159 | B2 | 5/2006 | Entezarian et al. |
| 7,077,893 | B2 | 7/2006 | Guilliard |
| 7,089,763 | B2 | 8/2006 | Forsberg et al. |
| 7,132,009 | B2 | 11/2006 | Chiang |
| 7,373,787 | B2 | 5/2008 | Forsberg et al. |
| 7,677,962 | B2 | 3/2010 | Chang |
| 7,687,740 | B2 | 3/2010 | Bruland et al. |
| 7,687,748 | B2 | 3/2010 | Gagas |
| 7,695,049 | B2 | 4/2010 | Colborne |
| 7,699,051 | B2 | 4/2010 | Gagas et al. |
| 7,717,107 | B2 | 5/2010 | Ota |
| 7,720,235 | B2 | 5/2010 | Abe et al. |
| 7,726,235 | B1 | 6/2010 | Frantz |
| 7,836,877 | B2 | 11/2010 | Gagas et al. |
| 8,191,464 | B2 | 6/2012 | Fraij et al. |
| 8,273,162 | B2 | 9/2012 | Pagano et al. |
| 8,312,873 | B2 | 11/2012 | Gagas et al. |
| 8,404,023 | B1 | 3/2013 | Osborne et al. |
| 8,669,499 | B2 | 3/2014 | Conrad |
| 8,728,189 | B2 | 5/2014 | Prasser |
| 8,852,307 | B2 | 10/2014 | Sikkenga et al. |
| 9,175,861 | B2 | 11/2015 | Sosso |
| 9,869,474 | B2 | 1/2018 | McEvoy |
| 9,897,328 | B2 | 2/2018 | McEvoy |
| 10,006,641 | B2 | 6/2018 | Bruckbauer |
| 10,139,113 | B2 | 11/2018 | McEvoy |
| 10,718,528 | B2 | 7/2020 | Bruckbauer |
| 11,454,402 | B1 * | 9/2022 | McEvoy ..... F24C 15/08 |
| 2003/0051606 | A1 | 3/2003 | Cusenza et al. |
| 2003/0146082 | A1 | 8/2003 | Gibson et al. |
| 2003/0231780 | A1 | 12/2003 | Enamito et al. |
| 2004/0020485 | A1 | 2/2004 | Roesler et al. |
| 2004/0035411 | A1 | 2/2004 | Livchak et al. |
| 2005/0167415 | A1 | 8/2005 | Satou et al. |
| 2005/0186108 | A1 | 8/2005 | Fields |
| 2005/0224069 | A1 | 10/2005 | Patil et al. |
| 2006/0032492 | A1 | 2/2006 | Bagwell et al. |
| 2006/0055193 | A1 | 3/2006 | Colborne |
| 2006/0278215 | A1 | 12/2006 | Gagas et al. |
| 2006/0278216 | A1 | 12/2006 | Gagas et al. |
| 2007/0023420 | A1 | 2/2007 | Gagas |
| 2007/0039345 | A1 | 2/2007 | Forsberg et al. |
| 2007/0062513 | A1 | 3/2007 | Gagas |
| 2008/0029081 | A1 | 2/2008 | Gagas et al. |
| 2008/0121224 | A1 | 5/2008 | Giles |
| 2008/0216668 | A1 | 9/2008 | Fraij et al. |
| 2009/0032011 | A1 | 2/2009 | Livchak et al. |
| 2009/0264060 | A1 | 10/2009 | Livchak et al. |
| 2010/0163549 | A1 | 7/2010 | Gagas et al. |
| 2011/0030560 | A1 | 2/2011 | Bohlen et al. |
| 2011/0033346 | A1 | 2/2011 | Bohlen et al. |
| 2012/0008100 | A1 | 1/2012 | Tani et al. |
| 2012/0083198 | A1 | 4/2012 | Sinur et al. |
| 2012/0118150 | A1 | 5/2012 | Brizes et al. |
| 2012/0174801 | A1 | 7/2012 | Chiang |
| 2012/0204855 | A1 | 8/2012 | Huber |
| 2012/0247345 | A1 | 10/2012 | Chiang |
| 2012/0247451 | A1 | 10/2012 | Chiang |
| 2013/0008317 | A1 | 1/2013 | Conrad |
| 2013/0042853 | A1 | 2/2013 | Chiang |
| 2013/0047857 | A1 | 2/2013 | Bohlen |
| 2013/0047858 | A1 | 2/2013 | Bohlen et al. |
| 2013/0047859 | A1 | 2/2013 | Bohlen |
| 2013/0052090 | A1 | 2/2013 | Bohlen |
| 2013/0333686 | A1 | 12/2013 | Chiang |
| 2014/0031135 | A1 | 10/2014 | Daniels |
| 2015/0031627 | A1 | 11/2015 | Donofrio |
| 2020/0031883 | A1 | 10/2020 | Bruckbauer |

FOREIGN PATENT DOCUMENTS

| | | |
|---|---|---|
| EP | 3133349 | 4/2019 |
| JP | 2011005175 | 1/2011 |
| JP | 2017036888 | 2/2017 |

(56) References Cited

FOREIGN PATENT DOCUMENTS

| | | |
|---|---|---|
| KR | 101314265 | 10/2013 |
| WO | 12146237 | 11/2012 |
| WO | 20020954 | 3/2020 |

* cited by examiner

FIG. 4
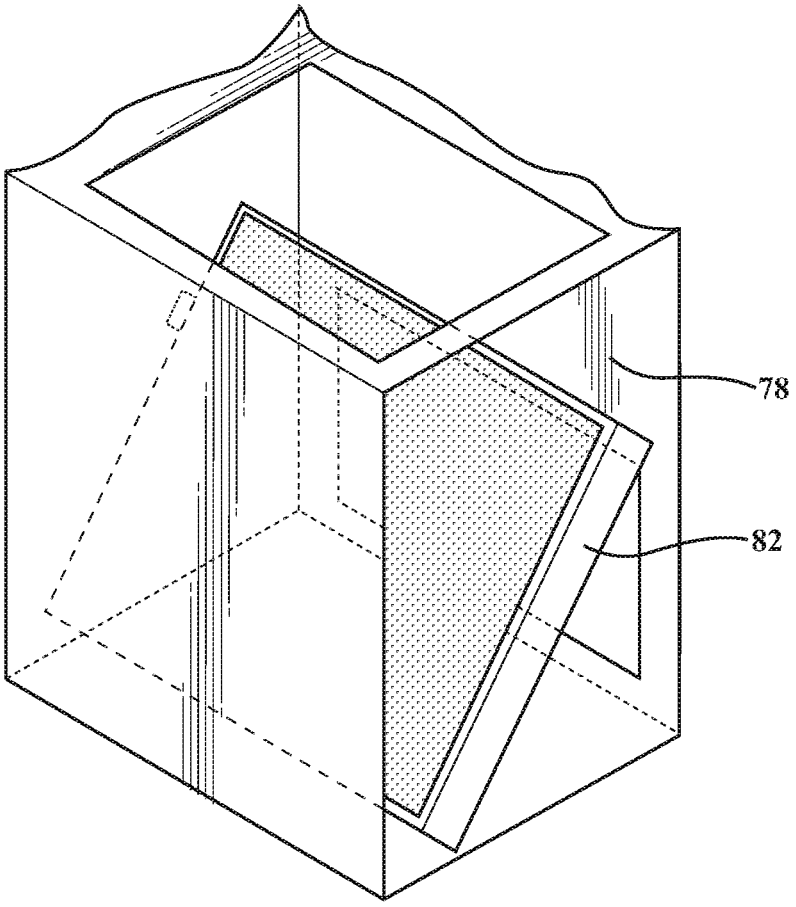
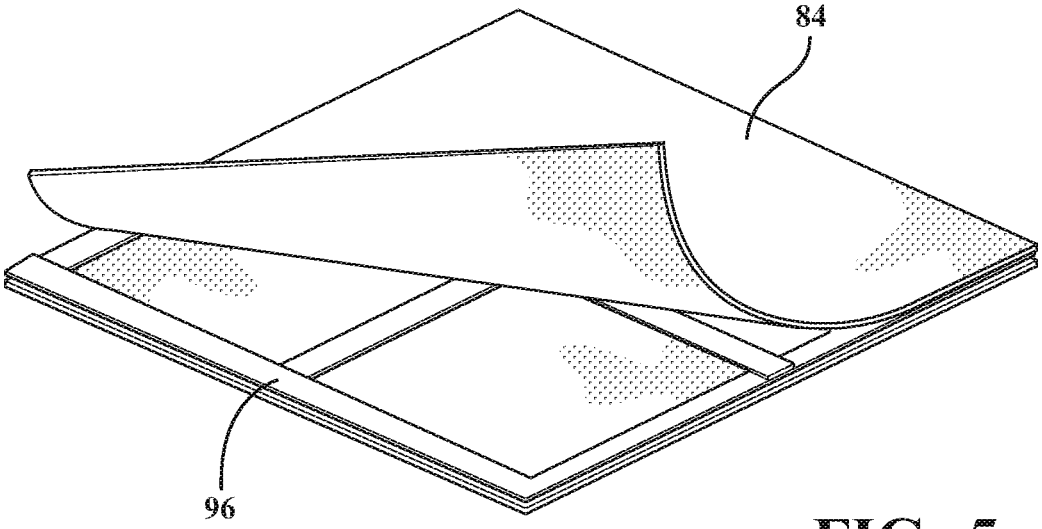
FIG. 5

TABLETOP COOKING ASSEMBLY

CROSS-REFERENCE TO RELATED APPLICATIONS

The present application is a continuation of U.S. patent application Ser. No. 17/539,461, filed on Dec. 1, 2021, which is hereby expressly incorporated herein by reference in its entirety.

BACKGROUND OF THE INVENTION

1. Field of the Invention

The present invention relates to a tabletop cooking assembly, particularly to a cooking assembly that can be used indoors without requiring exhausting or venting of the exhaust outdoors and without additional make-up air requirements while achieving adequate capture of smoke therefrom.

2. Description of the Related Art

Various cooktops are known for Korean barbeque and various cooktops having centrally mounted downdraft systems are known. However, none of the various cooktops are able to be exhausted to an area immediately adjacent the cooktop without venting outside and while also capturing adequate smoke generated from cooking food directly on the cooktop. One major complaint of guests or customers at such establishments is the smell after dining at the establishment because smoke having grease particulates dispersed therein escapes from the cooktop causing odors to linger on the customer. Generally, these types of cooktops require large and expensive overhead ducts to capture the smoke, but even still the smoke would not be sufficiently captured. The cooktops that do not have overhead ducts, commonly referred to as downdraft systems, are also inadequate for capturing smoke from the cooktop. Even still, those that have attempted to create adequate capture require large velocity blowers, which tend to cool the grill and are loud when used in such confined areas.

One such prior tabletop cooking assembly was designed for a teppanyaki table, which is generally larger than a Korean barbecue table, and is shown in U.S. Pat. No. 10,139,113. The '113 Patent discloses a high velocity blower that draws air from a vent disposed on one side, which pulls airs across a rectangular cooking surface. In order to achieve smoke capture, the high velocity blower had to achieve 750 feet per minute, which can contribute noise to the surrounding area.

Many cooking assemblies, such as stoves for household kitchens, have centrally mounted downdraft systems. One such assembly is shown in United States Patent Application Publication 2020/0318835 that discloses a central downward removal of cooking vapors by suction through a hob. The hob is disposed in the middle of various different cooking locations. Such a system allows smoke to escape from the outer edges of the cooking locations. Further, the cooking assembly is not used for cooking food directly on the cooking locations, instead pots and pans are used to cook the food thereon, which provides different types of issues.

United States Patent 2007/0062514 discloses a smokeless cooker cabinet that includes an indoor table and a gas-discharge flow path that leads from the cabinet to the outdoors. The smokeless cooker includes a grill that is disposed above a burner with an inner box and an outer box that forms a duct and an upper gap is between the inner box and the outer box. A top ring having a plurality of apertures is installed between the inner box and the outer box to shield the upper gap. Because the top ring merely closes the inner box and the outer box, sufficient smoke capture is not possible to exhaust indoors, thus the need to exhaust the smoke outdoors. Another example is shown in Chinese Patent Application Publication CN107997380A, which discloses a large exhaust duct surrounding a pan. The large exhaust duct does not allow for sufficient smoke capture.

Yet another cooking assembly is disclosed in U.S. Pat. No. 7,002,110. Specifically, an electric smokeless roaster is disclosed that has a suction unit that surrounds sides and a bottom of the pan to create suction down and through the grill or from above the grill. Since the suction unit surrounds the sides and bottom of the pan, inefficiencies of the suction unit allow smoke to escape from the grill and thus the smoke is not adequately captured. Similarly, U.S. Pat. No. 4,616,626 discloses a table cooker with a ventilator that is integral with the housing and that has an exhaust duct that surrounds the sides and bottom of the pan. Both systems are not able to create adequate smoke capture as a result of the exhaust duct/suction unit surrounding the entire pan and having ducts with large volumes that contribute to inefficient smoke collection.

BRIEF SUMMARY OF THE INVENTION

The subject invention discloses a tabletop cooking assembly for preparing foods thereon. The assembly comprises a burner element, a pan surrounding the burner element, a grill adjacent to the burner element for cooking food thereon, and an exhaust plenum adjacent to the grill having a plurality of apertures formed therein for drawing smoke away from the grill and an outlet for exhausting smoke therefrom. An exhaust duct is in fluid communication with the outlet of the exhaust plenum for removing smoke through the exhaust plenum and at least one filter assembly is in fluid communication with the exhaust duct having at least one filter disposed therein for filtering grease from the smoke as the smoke passes through the at least one filter. The subject invention also includes a blower in fluid communication with the exhaust duct and the at least one filter assembly for exhausting the smoke from the exhaust duct to an area outside of and immediately adjacent to the tabletop cooking assembly. The exhaust plenum according to the subject invention is further defined as having an interior wall, an exterior wall, a top and a bottom forming a defined volume around the grill to draw the smoke into the exhaust plenum and away from the grill such that the smoke does not pass through the grill or about the burner element.

Another embodiment of the subject invention discloses a tabletop cooking assembly for preparing foods thereon. The assembly comprises a burner element comprising a gas burner and a ceramic tile, a pan surrounding the burner element, a grill adjacent to the burner element for cooking food thereon, and an exhaust plenum adjacent to the grill having a plurality of apertures formed therein for drawing smoke away from the grill and an outlet extending therefrom for exhausting smoke therefrom. An exhaust duct is in fluid communication with the outlet of the exhaust plenum for removing smoke through the exhaust plenum, a first filter assembly in fluid communication with the exhaust duct having a first filter comprising a metal screen disposed within the first filter assembly for filtering grease from the smoke as the smoke passes through the first filter, and a second filter assembly in fluid communication with and downstream from the first filter assembly and having a second filter comprising a wool fiber disposed within the second filter assembly for filtering grease from the smoke as the smoke passes through the second filter. The embodiment also includes a blower in fluid communication with the exhaust duct having a blower capacity for drawing smoke through the exhaust plenum at a velocity of less than 500 feet per minute for removal of grease particulates with the first and second filter assemblies and for exhausting the smoke from the exhaust duct to an area outside of and immediately adjacent to the tabletop cooking assembly. The exhaust plenum in such embodiment is further defined as having a top, a bottom, an exterior wall, and an interior wall that extends perpendicularly between the top and the bottom. The top, the bottom, and the exterior and interior walls form a defined volume around the grill that is sealed other than the plurality of apertures and the outlet to achieve a desired smoke capture from the grill and to reduce smoke from escaping therefrom such that the smoke does not pass through the grill or about the burner element.

BRIEF DESCRIPTION OF THE SEVERAL VIEWS OF THE DRAWINGS

Other advantages of the present invention will be readily appreciated as the same becomes better understood by reference to the following detailed description when considered in connection with the accompanying drawings wherein:

FIG. 4 is a perspective view of a first filter assembly having a first filter disposed therein;

FIG. 5 is a perspective view of a second filter according to the subject invention;

DETAILED DESCRIPTION OF THE INVENTION

Figure 1:
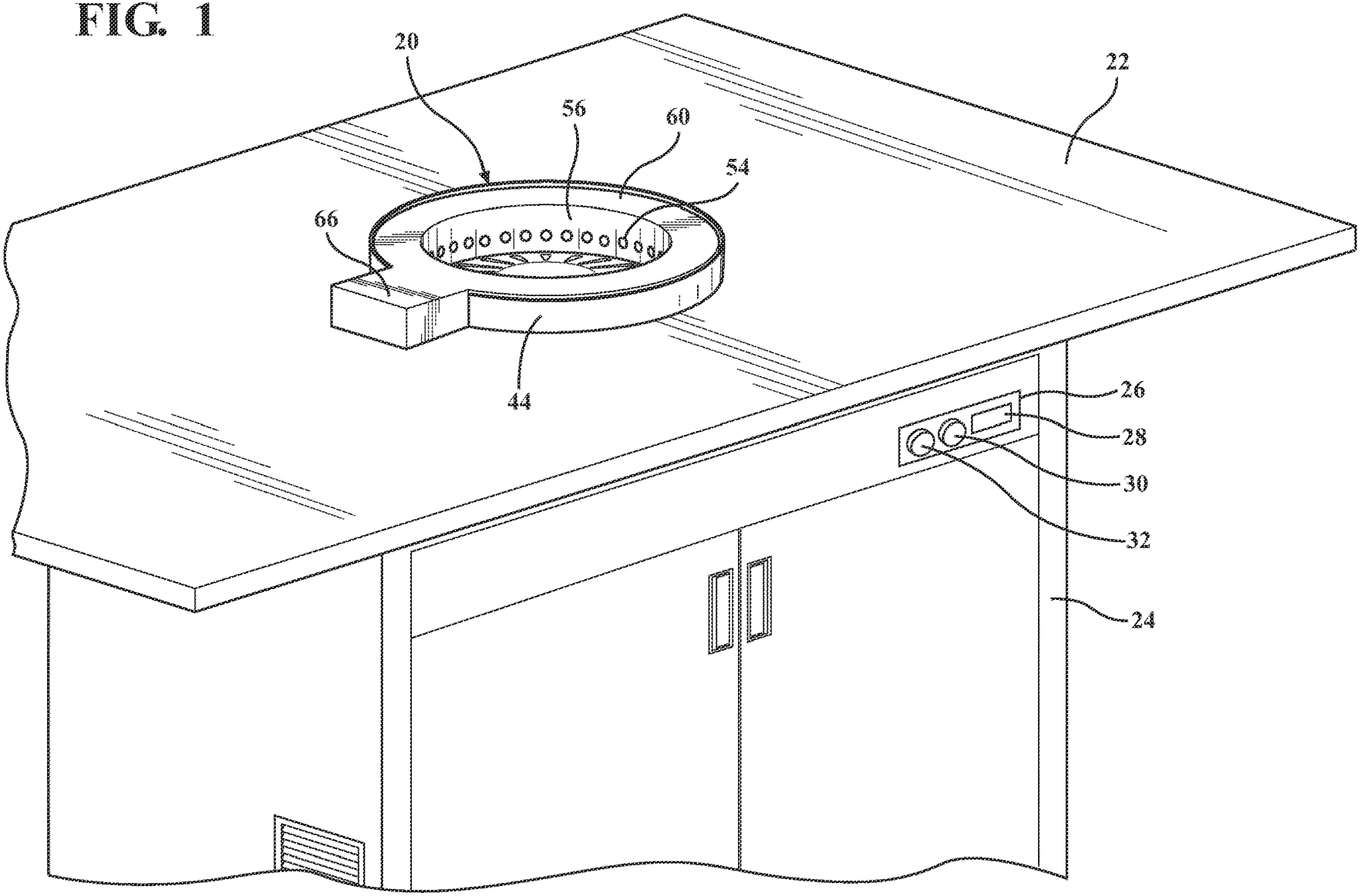
FIG. 1 is a perspective view of an embodiment of a tabletop cooking assembly for preparing foods.

Referring to the Figures, wherein like numerals indicate like parts throughout the several views, a tabletop cooking assembly for preparing foods there is shown generally at 20 in FIG. 1. A tabletop 22 is shown with the cooking assembly 20 disposed in the middle of the tabletop 22. A frame 24 generally supports the tabletop 22 and the cooking assembly 20. The tabletop 22 may have various configurations and shapes, i.e., circular, rectangular, and the like such that guest may be seated around the tabletop 22 while simultaneously cooking food on the cooking assembly 20. Such tabletop cooking assemblies 20 are commonly referred to Korean barbecue tables or roaster grills.

The frame 24 may be fixed in one location or may be portable, i.e., supported by wheels (not shown). One advantage of the subject invention is that it does not require exhausting smoke outside if the cooking assembly 20 is used inside of a building. Therefore, dedicated or fixed duct work within the interior of the building that exhausts outside of the building is not required, which significantly reduces the cost of the cooking assembly 20, as well as installation costs. As a result of not being connected to fixed duct work, the cooking assembly 20 according to the subject invention may be portable, allowing for different configuration and layouts to accommodate different numbers of guests by moving adjacent cooking assemblies together. Such advantages where not possible for cooking assemblies that required permanently mounted ducts to vent outdoors.

As shown in FIG. 1, the cooking assembly 20 is shown as being circular, but other shapes, such as rectangular in shape, can be used for the cooking assembly 20, as will be discussed below. Further, the cooking assembly 20 may be raised from the tabletop 22 or flush with the tabletop 22. A control panel 26 is used to control the cooking assembly 20 and typically includes an on/off switch 28, a blower motor switch 30, and a temperature setting control 32.

Figure 2:
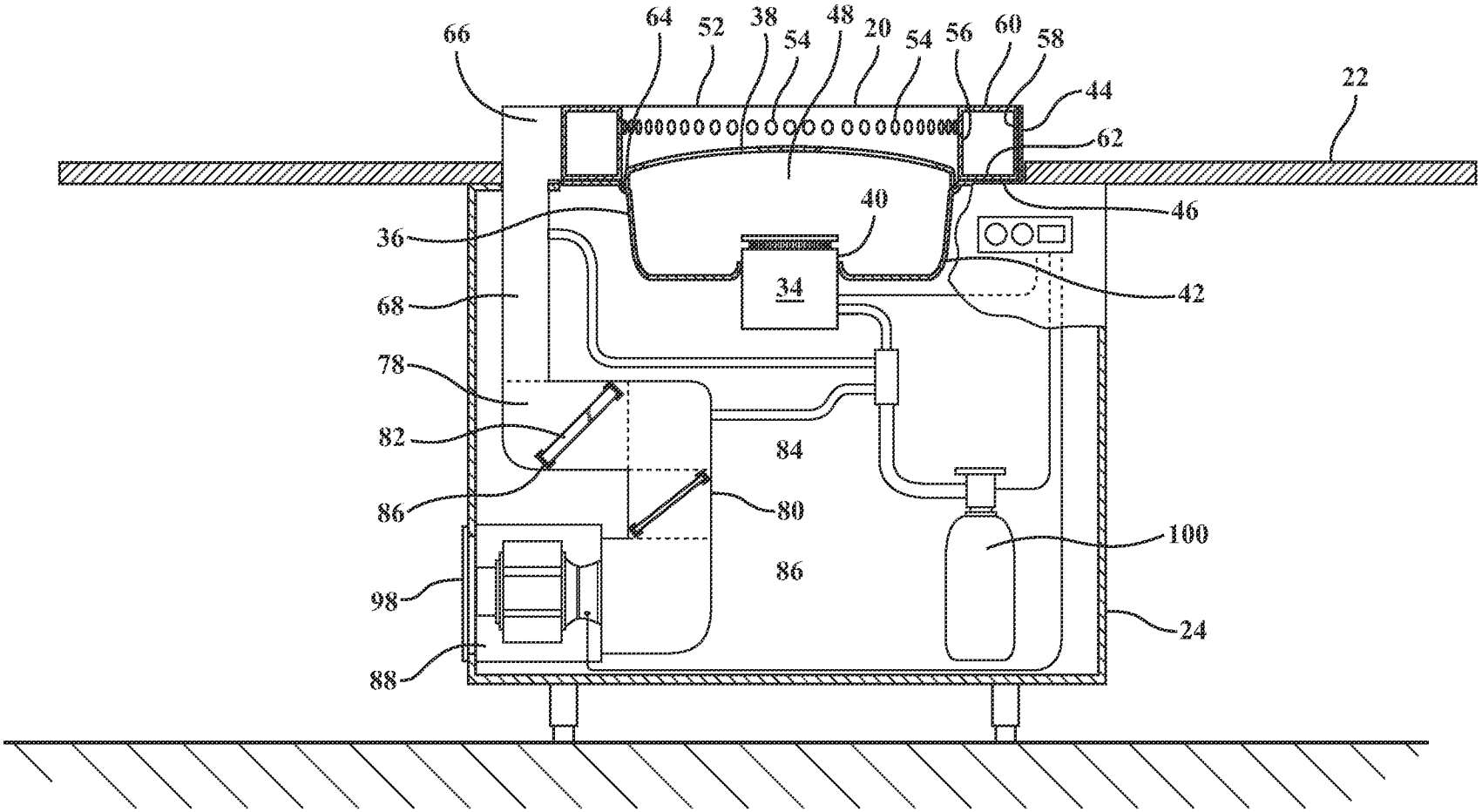
FIG. 2 is a cross-sectional view of the cooking assembly according to the embodiment shown in FIG. 1.

With reference to FIG. 2, a cross-sectional view of the cooking assembly 20 according to one embodiment is shown. The cooking assembly 20 includes a burner element 34 and a pan 36 surrounding the burner element 34 and a grill 38 disposed adjacent to the burner element 34 for cooking food thereon. The burner element 34 may be electric or gas. If the burner is electric, an electric supply (not shown) would be connected thereto as is well known to those of ordinary skill in the art. If the burner is gas, a gas supply (not shown) would be connected thereto as is well known to those of ordinary skill in the art.

Figure 3:
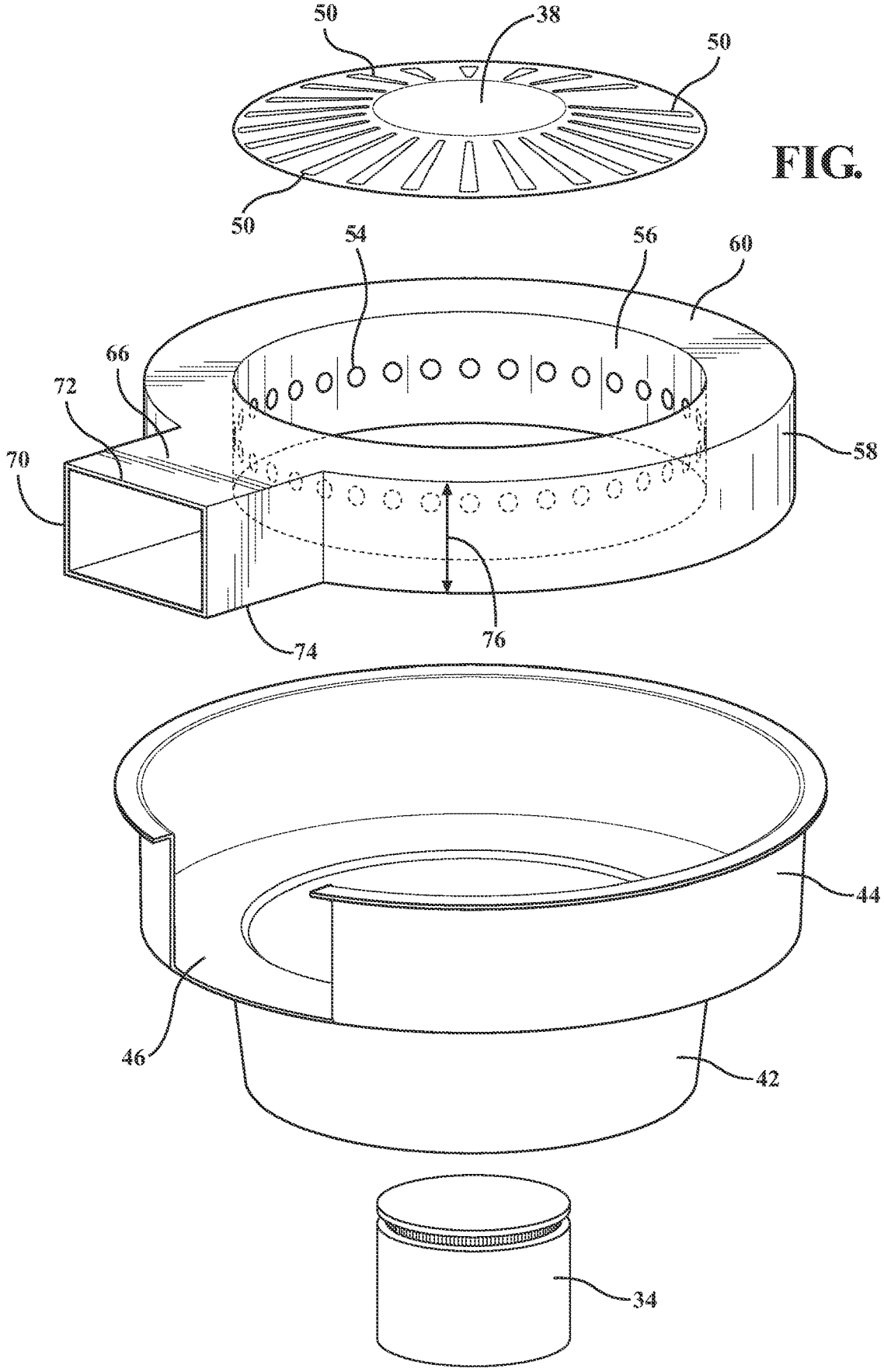
FIG. 3 is an exploded view of a burner element, a pan, an exhaust plenum, and a grill formed according to embodiment of the subject invention shown in FIG. 1.

As best shown in FIG. 3, the pan 36 is generally bowl-shaped with an opening 40 to receive the burner element 34. The pan 36 may include a lower bowl 42 that surrounds the burner element 34 and an upper bowl 44. A flange 46 interconnects the lower bowl 42 and the upper bowl 44 and the flange 46 supports the pan 36 relative to the burner element 34 and tabletop 22. In the embodiment shown, the lower bowl 42 has continuous side walls 48 to limit or prevent smoke from escaping into the assembly 20. Additionally, the pan 36 may further include a water pan (not shown), either integral with the lower bowl 42 or as a separate component for capturing any liquids from food that is cooked on the grill 38. Preferably, the pan 36 is removeable from the cooking assembly 20 to allow for easy cleaning and maintenance.

The grill 38 may also be supported by the flange 46. The grill 38 is typically formed of a metal material that has good heat transfer properties that heats up sufficiently quickly for cooking food thereon. The grill 38 has slots 50 for allowing grease or other liquids to drain through the grill 38. The grill 38 may have a flat surface or a convex surface for receiving the food directly on the grill to be cooked. As the food is cooked, smoke that contains grease particulates is generated and rises from the grill 38.

With reference back to FIG. 2, the cooking assembly 20 further includes an exhaust plenum 52 adjacent to the grill 38. The exhaust plenum 52 has a plurality of apertures 54 formed therein for drawing smoke away from the grill 38. Specifically, the exhaust plenum 52 has an interior wall 56, an exterior wall 58, a top 60 and a bottom 62, which form a defined volume around the grill 38 to draw the smoke into the exhaust plenum 52 and away from the grill 38 such that the smoke does not pass downward through the grill 38 or about the burner element 34. The defined volume creates a path of air flow around the grill 38 as opposed to prior systems that pulled air through the grill 38. The interior wall 56 defines an opening 64 that receives the grill 38 and the grill 38 is disposed adjacent the bottom 62.

In the embodiment shown in FIG. 2, the exhaust plenum 52 has a rectangular cross-section. It is to be appreciated that other cross-sections may be used with the subject invention; however, the specific configuration of the exhaust plenum 52 contributes the efficiency of the smoke collection from the grill 38. In order to vent the exhaust in the interior of the building, without having to vent outside of the building, certain amounts of the smoke must be captured, such as at least 90 percent. Preferably, the smoke collection is from 92-100 percent from the grill 38. However, it is appreciated that such collection amount may be less while still being acceptable in various jurisdictions for exhausting inside of a building without additional make-up air.

As best shown in FIG. 3, the exhaust plenum 52 also has an outlet 66 extending therefrom. The outlet 66 connects the exhaust plenum 52 to an exhaust duct 68. The outlet 66 only extends around a portion of a periphery of the exhaust plenum 52. In this manner, the air flow exhausts the exhaust plenum 52 from one location and concentrates the air flow to achieve the necessary pressure and air flow, unlike prior systems that pulled the air flow from the entire periphery and down and around the burner. In order to achieve satisfactory smoke collection, the cooking assembly 20 has to pull sufficient air and smoke through the apertures 54 into the defined volume and through the outlet 66 which is impacted by a height 70, a width 72, and a length 74 of the outlet 66. In one embodiment, the outlet 66 has a width 72 of less than 20% of the periphery of the exhaust plenum 52 to achieve adequate smoke collection. In the embodiment shown, the height 70 of the outlet 66 is the same as a height 76 of the exhaust plenum 52. Alternatively, if additional air pressure is needed, the height 70 of the outlet 66 may be less than the height 76 of the exhaust plenum 52. In other embodiments, the length 74 is less than 15 percent of the exhaust plenum 52 circumference or periphery. In another embodiment, the length 74 is less than 10 percent. Since the outlet 66 has the length 74 is significantly less than the exhaust plenum 52 periphery, higher air pressure can be obtained to pull the smoke into the exhaust plenum 52. The related art systems are not able to generate enough pressure to ensure adequate smoke capture.

Another aspect of achieving adequate smoke capture is that the defined volume of the exhaust plenum 52 is sealed other than the plurality of apertures 54 and the outlet 66. To be sealed does not require complete sealing, however, the subject invention limits the amount of air that can escape from the exhaust plenum 52 by reducing the potential inefficiencies and controlling the configuration as described herein. Since the lower bowl 42 of the pan 36 provides the continuous surface, little or no smoke escapes through the center of the cooking assembly 20 and instead the smoke is drawn into the exhaust plenum 52 through the apertures 54.

Referring back to FIG. 2, the subject invention further includes the exhaust duct 68 in fluid communication with the outlet 66 of the exhaust plenum 52 for removing smoke through the exhaust plenum 52. At least one filter assembly is in fluid communication with the exhaust duct 68 having at least one filter disposed within the at least one filter assembly for filtering grease from the smoke as the smoke passes through the at least one filter. In the embodiment shown, the at least one filter assembly is further defined as a first filter assembly 78 and a second filter assembly 80 downstream from the first filter assembly 78, and the at least one filter is further defined as a first filter 82 disposed in the first filter assembly 78 and a second filter 84 disposed in the second filter assembly 80. Referring to FIG. 4, the first filter 82 is preferably a metal screen disposed within the first filter assembly 78 for filtering grease from the smoke as the smoke passes through the first filter 82. With reference to FIG. 5, the second filter 84 is a grease filter comprising a wool fiber therethrough mounted on a supporting frame 96 and having a thickness and configuration sufficient to allow smoke to flow. The wool fiber absorbs grease particulates dispersed in the smoke passing therethrough. The wool fiber may be replaceable or the wool fiber may be reusable.

Both the first and the second filters 82, 84 are supported by filter brackets 86 that may have a plurality of perforations (not shown) to allow the passage of grease from the filters, through the bracket and into the standard drawers (not shown).

The filters are removable from the filter assemblies for allowing cleaning or replacement. The second filter 84 may also include flame resistant viscose fibers mixed with the wool fibers and woven together, and bonded together with a bonding emulsion that may contain additional additives such as fire retardant, fire suppressant, anti-microbial, anti-bacterial, color dyes, etc.

Referring back to FIG. 2, the subject invention further includes a blower 88 in fluid communication with the exhaust duct 68 and the at least one filter assembly for exhausting the smoke from the exhaust duct 68 to an area outside of and immediately adjacent to the tabletop cooking assembly 20, as discussed above. The blower 88 preferably has a blower capacity for drawing smoke through the exhaust plenum 52 at a target velocity of about 500 feet per minute for removal of grease particulates with the at least one filter assembly. In order to achieve the target velocity, the blower 88 has a discharge efficiency as measured by the air collected through the apertures 54 of at least 50% and more preferably 75%, such that the blower capacity of the blower 88 is from 500 cubic feet per minute up to 1000 cubic feet per minute. In another embodiment, the target velocity is from 250-425 cubic feet per minute. By having lower velocity, the smoke passes through the filter assemblies 78, 80 slower, which allows for more grease to be removed.

Figure 6:
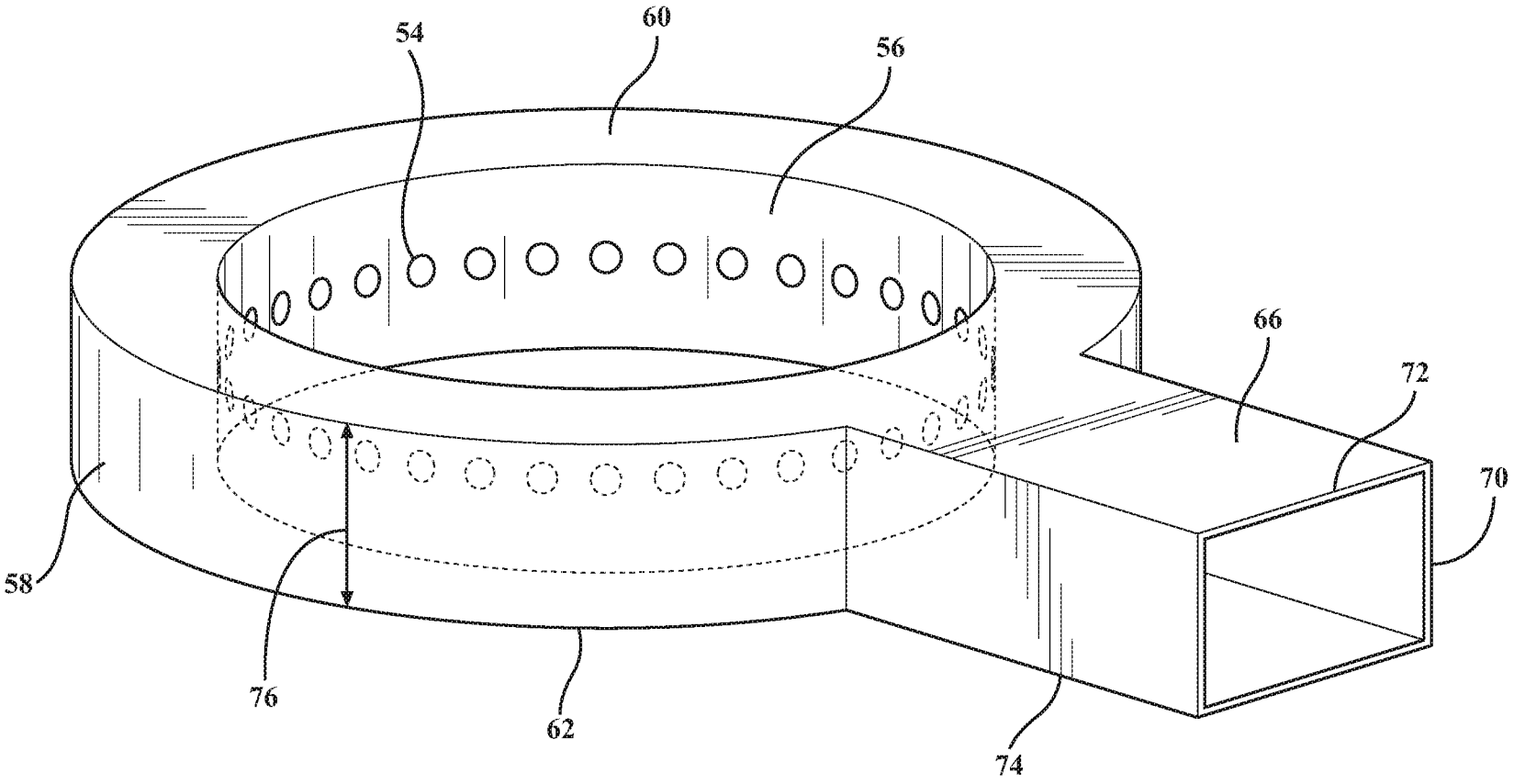
FIGS. 6-12 are perspective views of various embodiments of exhaust plenums formed according to the subject invention.

FIG. 6 is perspective view of one embodiment of the exhaust plenum 52 that is ring-shaped and has a rectangular-shaped cross-section. The outlet 66 has the height 70 that is the same as the height 76 of the exhaust plenum 52. The interior wall 56 extends perpendicularly between the top 60 and the bottom 62 and has the apertures 54 that are circular shaped. The apertures 54 are disposed equidistance between the top 60 and the bottom 62 and equidistant about the circumference of the interior wall 56. Preferably, the apertures 54 have a diameter of from about 0.25 inches to 2 inches to increases efficiency of smoke collection. The exhaust plenum 52 extends outwardly from the exterior wall 58 for connecting to the exhaust duct 68.

Figure 7:
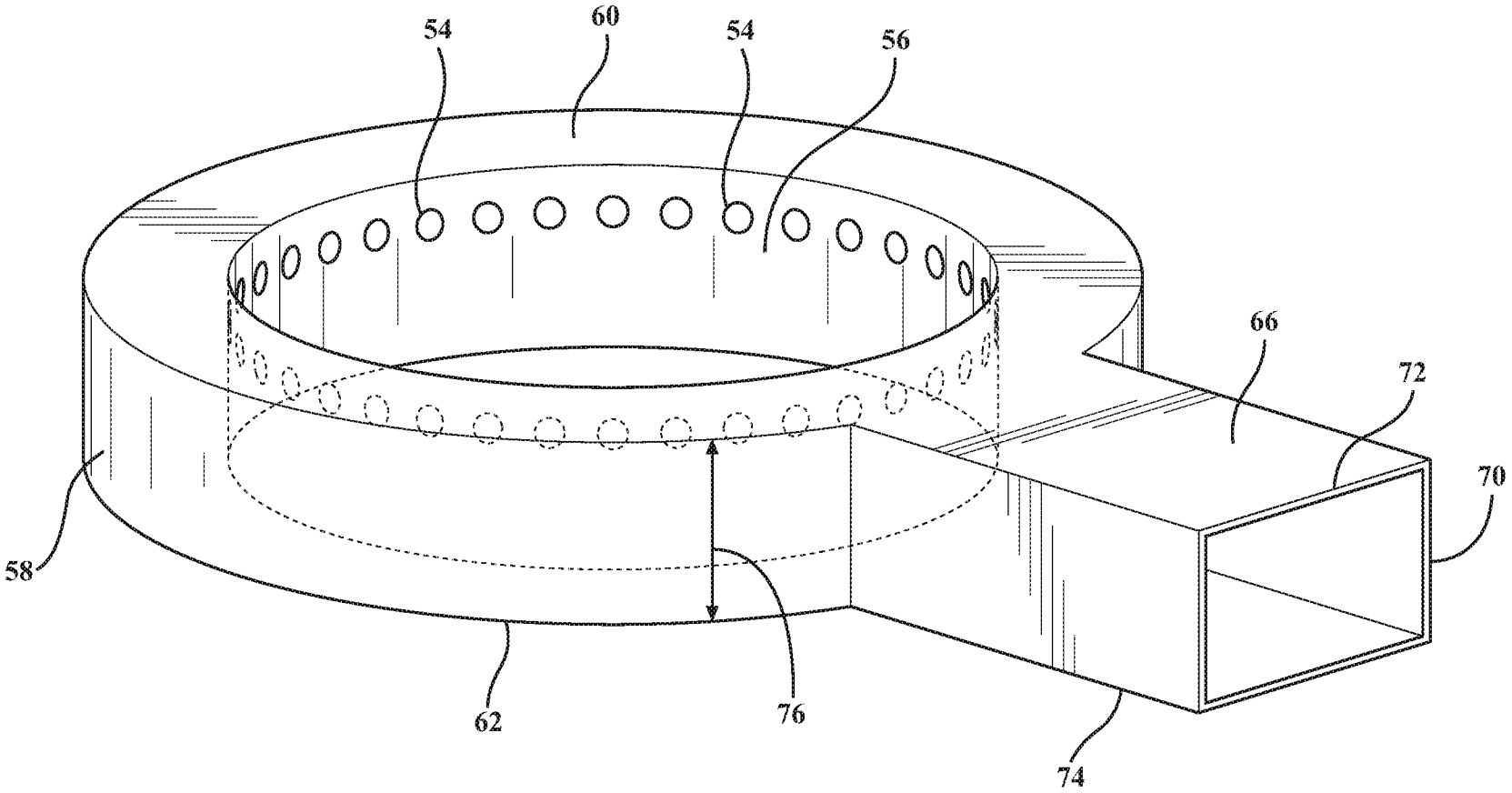
Figure 8:
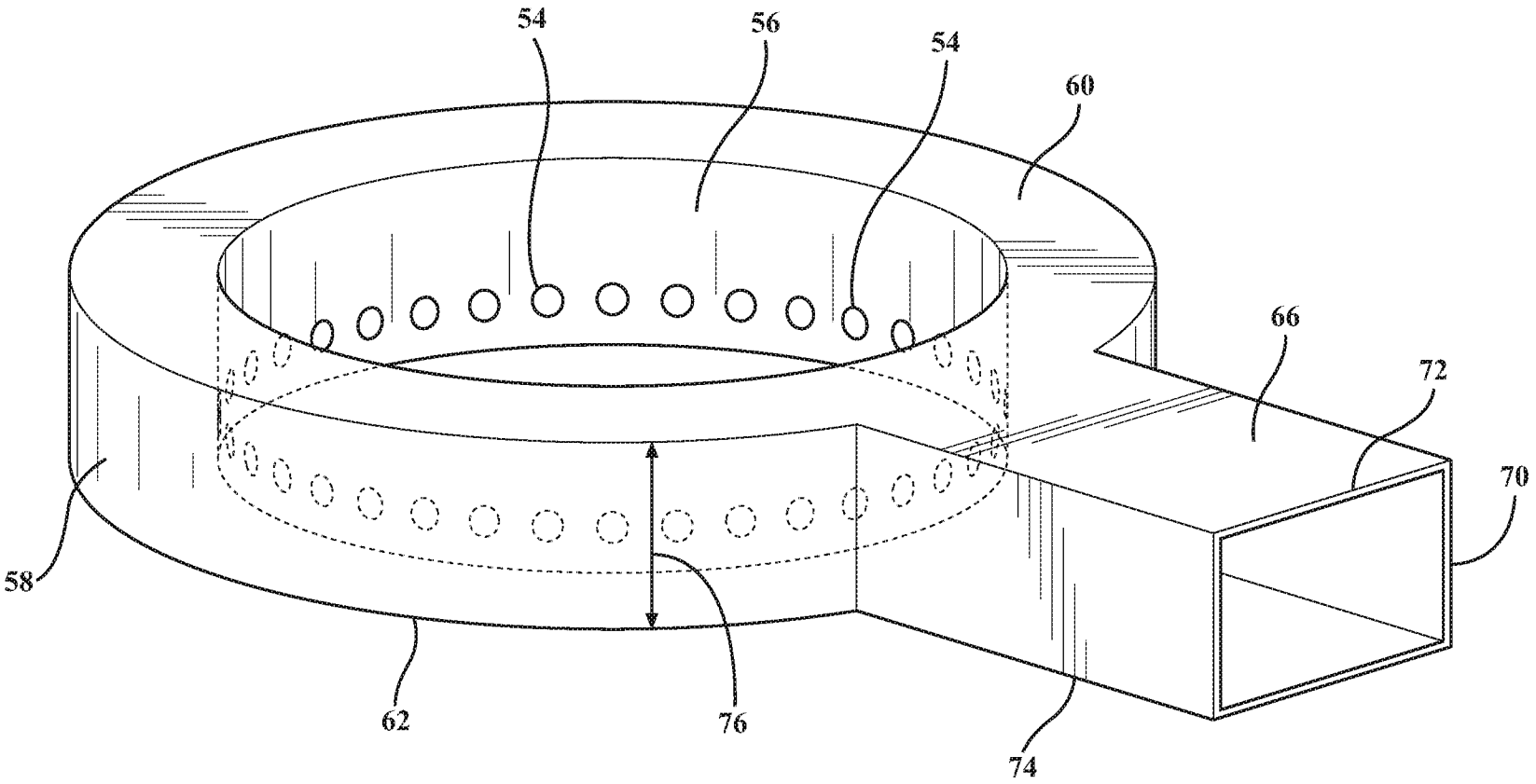
Figure 9:
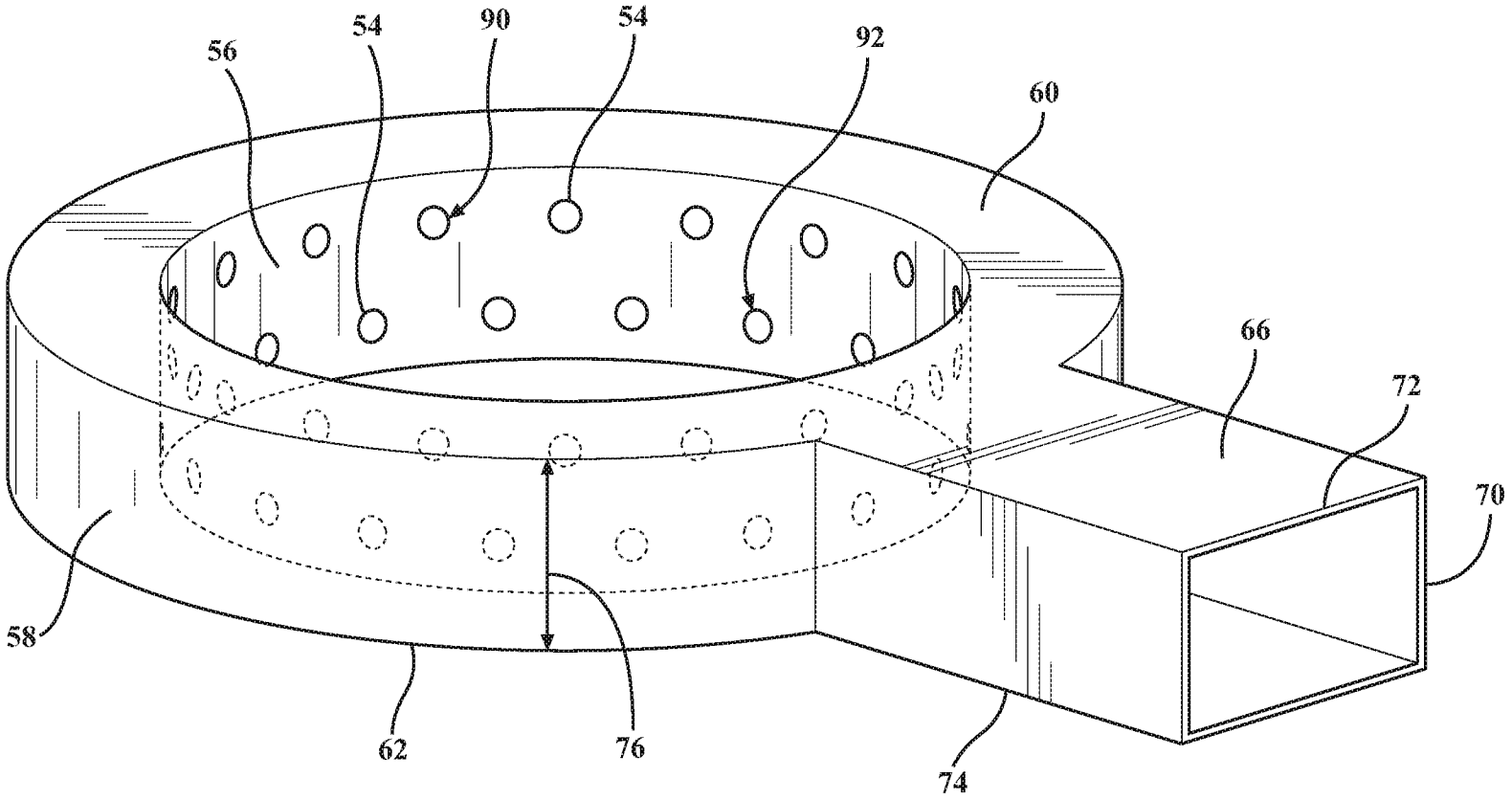
Figure 10:
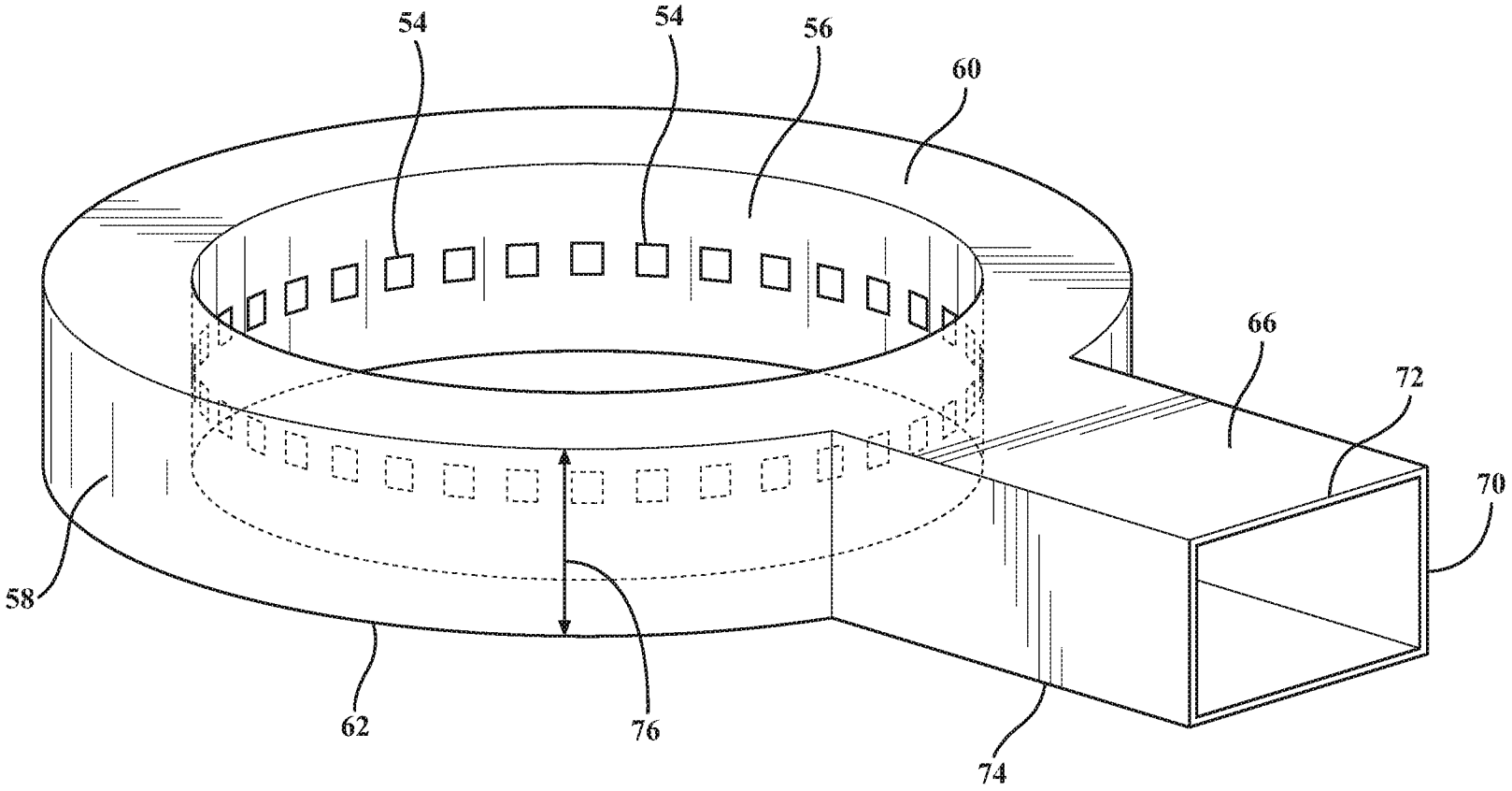
Figure 11:
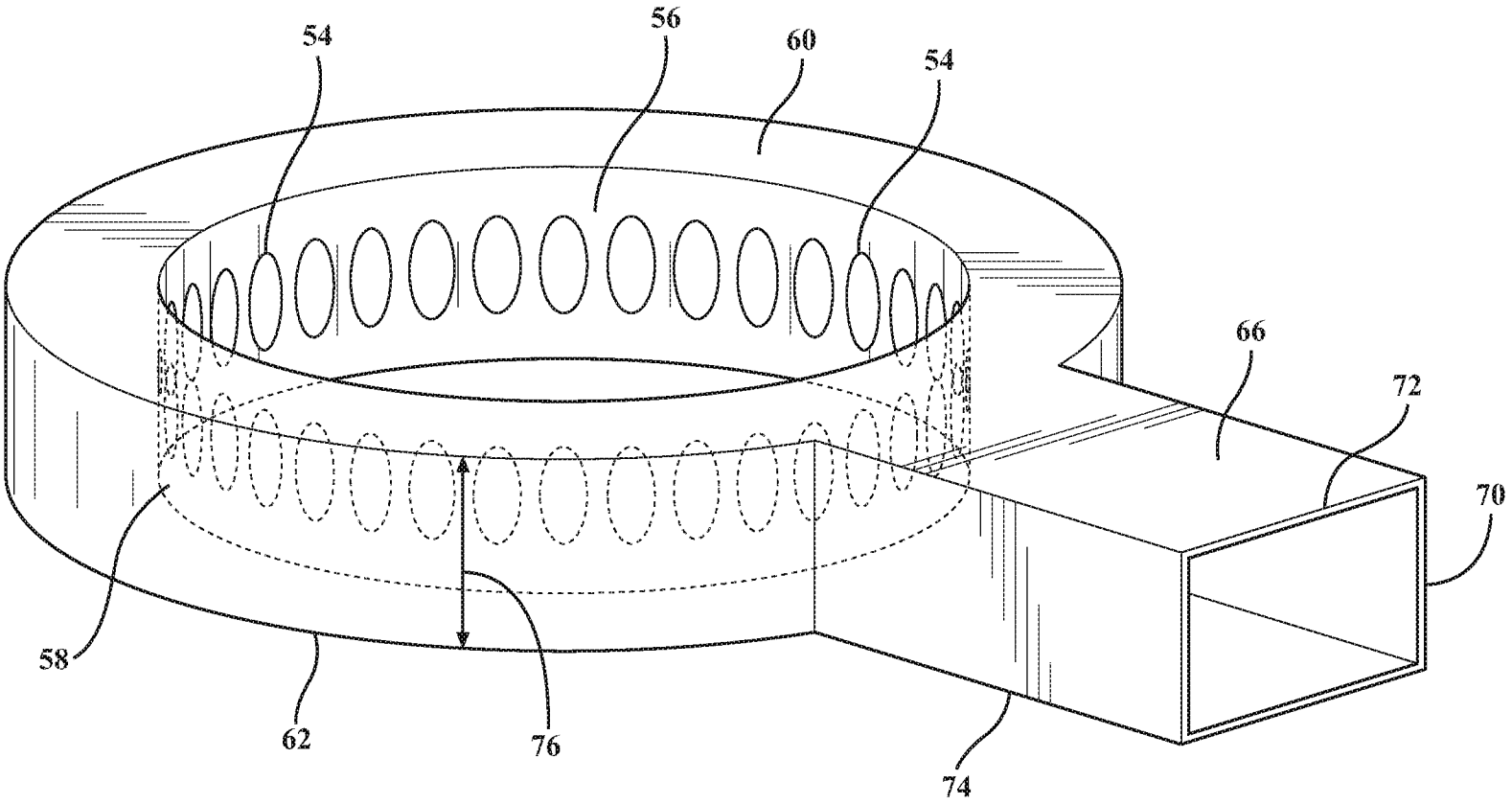

FIG. 7 is a perspective view of another embodiment of the exhaust plenum 52 having the plurality of apertures 54 disposed nearer to the top 60 than the bottom 62. In this way, as the smoke rises from the grill 38, the smoke would be captured and pulled into the defined volume of the exhaust plenum 52. FIG. 8 is a perspective view of yet another embodiment of the exhaust plenum 52 having the plurality of apertures 54 disposed nearer to the bottom 62 than the top 60. FIG. 9 is a perspective view of still another embodiment of the exhaust plenum 52 having the plurality of apertures 54 defined as comprising a first row 90 and a second row 92 with the first row 90 spaced closer to the top 60 and the second row 92 spaced closer to the bottom 62. FIG. 10 is a perspective view of yet still another embodiment of the exhaust plenum 52 having the plurality of apertures 54 defined as being quadrilateral-shaped to increases efficiency of smoke collection. While the apertures 54 are shown as squares, it is to be appreciated the quadrilateral-shaped apertures 54 could be rectangular without deviating from the subject invention. Referring to the embodiment shown in FIG. 11, the apertures 54 are shown as oval-shaped.

Figure 12:
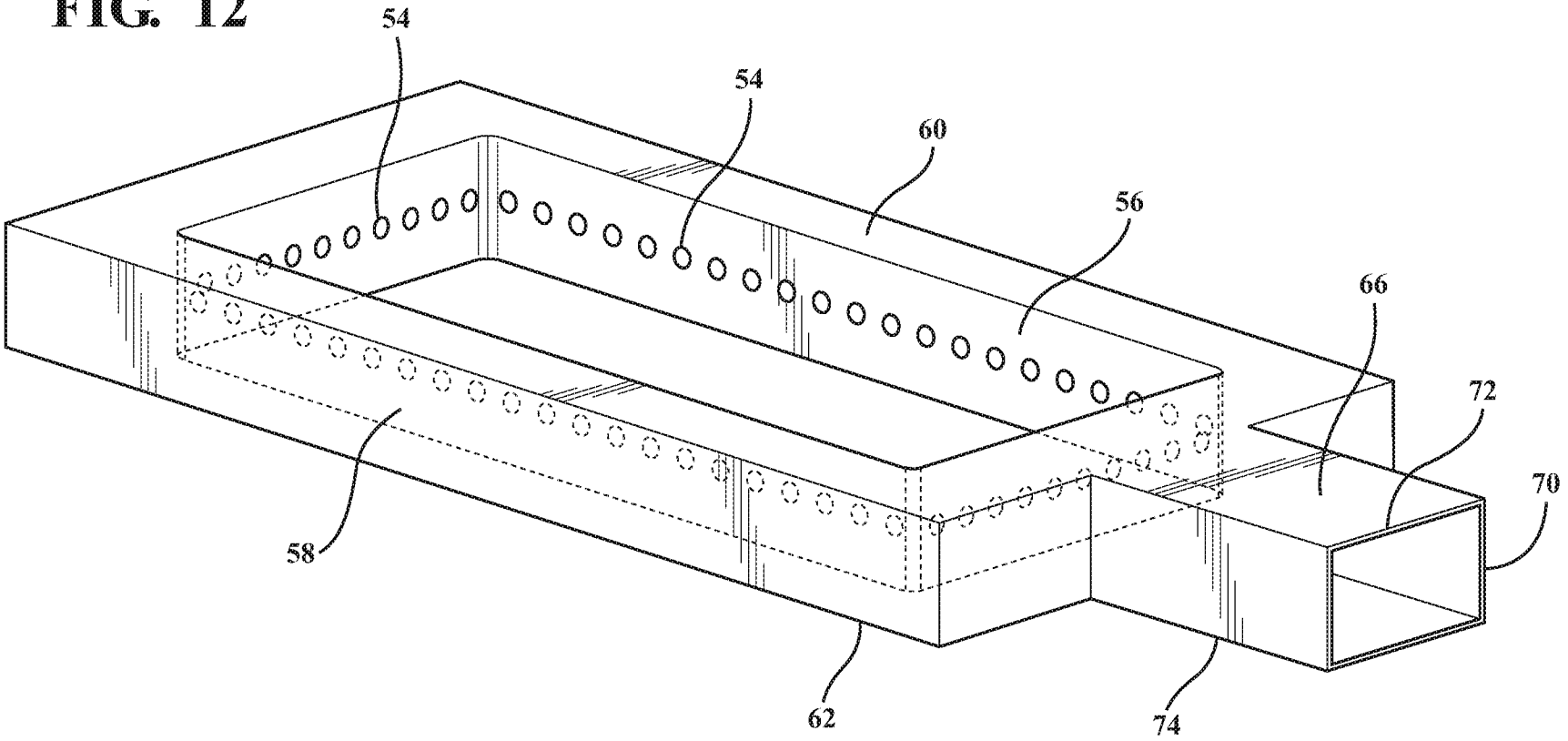

The cooking assembly 20 of the subject invention can also be used with rectangular shaped grills 38, wherein the exhaust plenum 52 would be rectangularly shaped, as shown in FIG. 12. The outlet 66 is shown extending outwardly from the exterior wall 58 forming a shorter side. By locating the exhaust on the shorter side, the subject invention is able to pull sufficient smoke into the exhaust plenum 52 and have the desired smoke capture.

Figure 13:
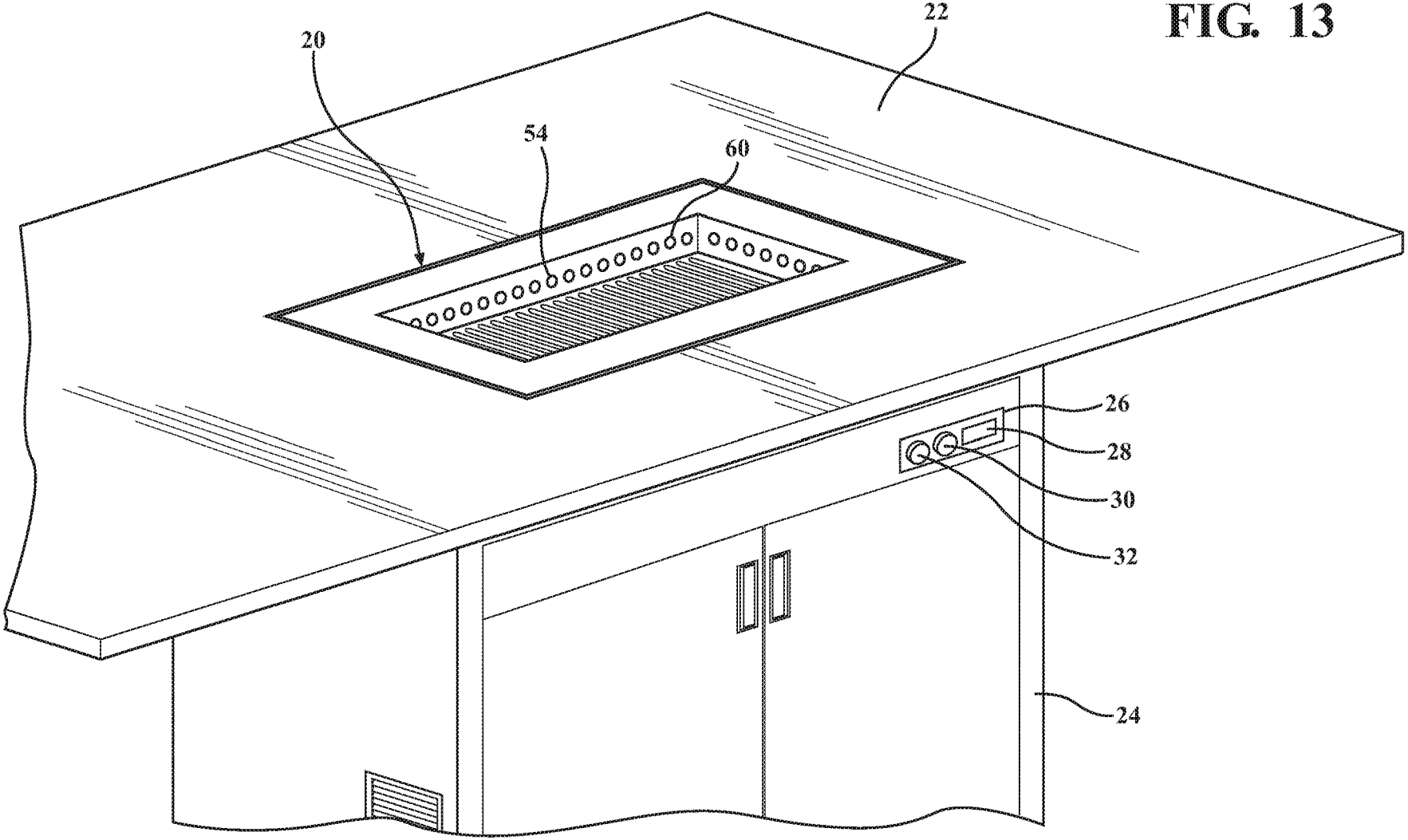
FIG. 13 is a perspective view of another embodiment of a tabletop cooking assembly for preparing foods.
Figure 14:
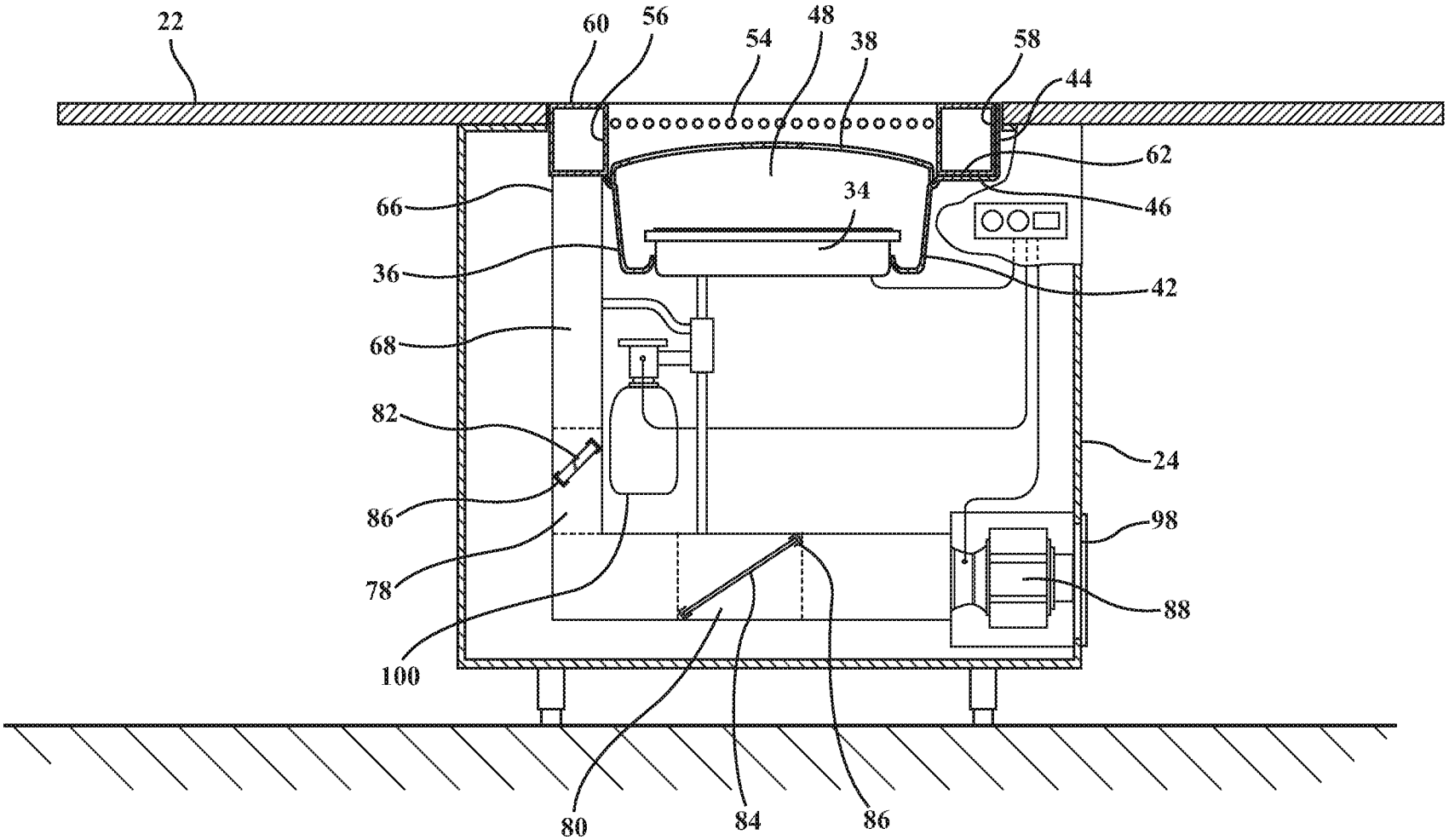
FIG. 14 is a cross-sectional view of the cooking assembly according to the embodiment shown in FIG. 13.
Figure 15:
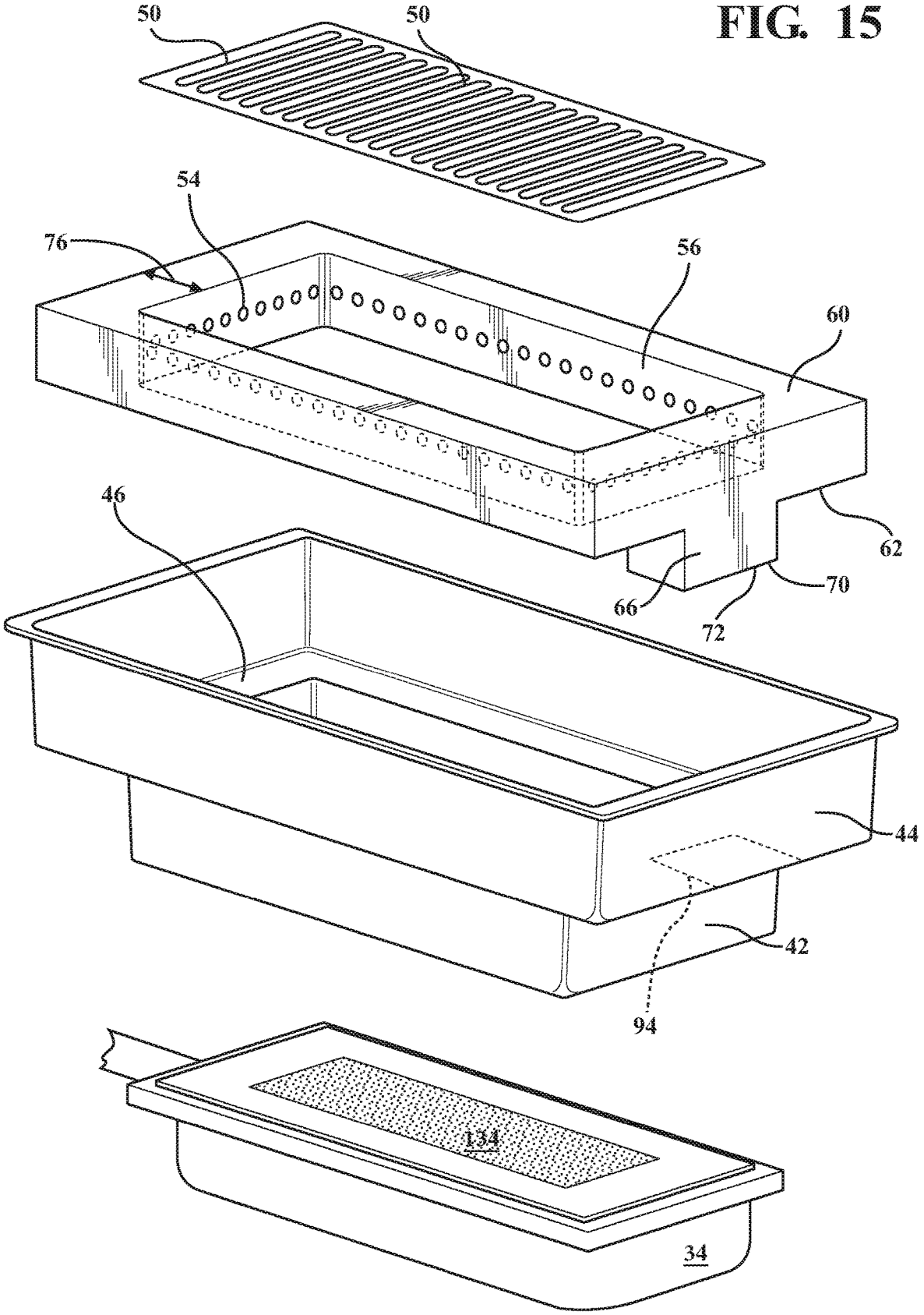
FIG. 15 is an exploded view of a burner element, a pan, an exhaust plenum, and a grill formed according to embodiment of the subject invention shown in FIG. 13.

Referring to FIG. 13, a perspective view of an alternative embodiment is shown having the exhaust plenum 52 flush with the tabletop 22 and being rectangularly shaped. As shown in FIGS. 14 and 15, the outlet 66 of the exhaust plenum 52 extends downwardly from the bottom 62 for connecting to the exhaust duct 68. Further, the flange 46 of the pan 36 has a slot 94 for the downwardly extending outlet 66. Similar to the embodiments described above, the outlet 66 has a length 74 that is substantially less than the circumference of the exhaust plenum 52. Preferably, the length 74 is less than 20 percent of the exhaust plenum 52 circumference or periphery. In another embodiment, the length 74 is less than 10 percent of the exhaust plenum 52 circumference or periphery. Since the outlet 66 has the length 74 is significantly less than the exhaust plenum 52 periphery, higher air pressure can be obtained to pull the smoke into the exhaust plenum 52. The related art systems are not able to generate enough pressure to ensure adequate smoke capture. Further, in this embodiment, the burner element 34 comprises the gas burner 34 and a ceramic tile 134 to provide a consistent cooking temperature for the grill 38. One such burner element 34 is available from Solaronics.

The cooking assembly 20 of the subject invention may further include a muffler 98 disposed downstream from the blower 88 for dissipating noise from the assembly 20. The muffler 98 helps reduce noise of the subject invention. The subject invention may further include a deodorizer (not shown), either integral with the muffler 98 or separate, in fluid communication with the exhaust dust for removing offending orders from the exhaust. This provides yet another mechanism for removing particles from the smoke and ensuring that the discharge air meets local air quality standards. Typically, for air to be exhausted into a closed environment without the requirement for fresh make-up air, there needs to be less than 10 ppm of grease in the smoke. The subject invention achieves these requirements. More specifically, the subject invention provides exhaust with less than 5 ppm of grease in the smoke. Because of these advantages, the subject invention can then be used in closed environments without the need for fresh air make-up and without the need for exhausting outside.

The subject invention may also include a plurality of switches and sensors (not shown) that are monitored by the controller and a fire suppression system 100. Specifically, a first filter switch, a second filter switch, and a muffler switch, if present may be used. The filter switch detects the presence of the filters. The muffler switch detects the presence of the muffler 98. The fire suppression system 100 includes a tank of fire retardant that is directed and dispensed into the cooking assembly 20 if needed.

Several versions and configurations have been discussed in the foregoing description. However, the configurations discussed herein are not intended to be exhaustive or limit the invention to any particular form. The terminology which has been used is intended to be in the nature of words of description rather than of limitation. Many modifications and variations are possible in light of the above teachings and the invention may be practiced otherwise than as specifically described. Therefore, it is an object of the appended claims to cover all such modifications and variations that come within the true spirit and scope of this invention.

What is claimed is:

1. A tabletop cooking assembly, said assembly comprising:

a burner element;

a pan surrounding said burner element;

a grill adjacent to said burner element for cooking food directly thereon;

an exhaust plenum adjacent to said grill having a plurality of apertures formed therein for drawing smoke away from said grill and an outlet extending therefrom for concentrating exhausting smoke therefrom;

an exhaust duct in fluid communication with said outlet of said exhaust plenum for removing smoke through said exhaust plenum;

at least one filter assembly in fluid communication with said exhaust duct having at least one filter disposed within said at least one filter assembly for filtering grease from the smoke as the smoke passes through said at least one filter;

a blower in fluid communication with said exhaust duct and said at least one filter assembly for exhausting the smoke from said exhaust duct to an area outside of and immediately adjacent to said tabletop cooking assembly;

wherein said exhaust plenum is further defined as having an interior wall, an exterior wall, a top and a bottom forming a defined volume around said grill to draw the smoke into said exhaust plenum and away from said grill such that the smoke does not pass through said grill or about said burner element; and wherein said outlet is further defined as having a width less than a periphery of said exhaust plenum such that air flow is concentrated through the exhaust plenum to achieve the necessary pressure and air flow therefrom.

2. The assembly as set forth in claim 1, wherein said defined volume of said exhaust plenum is further defined as being sealed other than said plurality of apertures and said outlet to achieve a desired smoke capture from said grill and to reduce smoke from escaping therefrom.

3. The assembly as set forth in claim 2, wherein said exhaust plenum and said outlet are further defined as having a rectangular cross-section.

4. The assembly as set forth in claim 1, wherein said at least one filter assembly is further defined as a first filter assembly and a second filter assembly downstream from said first filter assembly, and wherein said at least one filter is further defined as a first filter disposed in said first filter assembly and a second filter disposed in said second filter assembly.

5. The assembly as set forth in claim 4, wherein said second filter is further defined as a grease filter comprising a wool fiber having a thickness and configuration sufficient to allow smoke to flow therethrough and to absorb grease particulates dispersed in the smoke passing therethrough.

6. The assembly as set forth in claim 1, wherein said blower is further defined as having a blower capacity for drawing smoke through said exhaust plenum at a velocity of less than 500 feet per minute for removal of grease particulates with said at least one filter assembly.

7. The assembly as set forth in claim 1, wherein said exhaust plenum is further defined as being ring-shaped.

8. The assembly as set forth in claim 7, wherein said interior wall defines an opening that receives said grill and wherein said grill is disposed adjacent said bottom.

9. The assembly as set forth in claim 1, wherein said outlet extends outwardly from said exterior wall for connecting to said exhaust duct.

10. The assembly as set forth in claim 1, wherein said outlet extends downwardly from said bottom for connecting to said exhaust duct.

11. The assembly as set forth in claim 1, wherein said interior wall extends perpendicularly between said top and said bottom.

12. The assembly as set forth in claim 1, wherein said plurality of apertures are disposed nearer to said top than said bottom.

13. The assembly as set forth in claim 1, wherein said plurality of apertures are further defined as being circular-shaped with a diameter of from about 0.25 inches to 2 inches to increases efficiency of smoke collection.

14. The assembly as set forth in claim 1, wherein said plurality of apertures are further defined as being quadrilateral-shaped to increases efficiency of smoke collection.

15. The assembly as set forth in claim 1, wherein said plurality of apertures are further defined as comprising a first row and a second row with said first row spaced closer to said top and said second row spaced closer to said bottom.

* * * * *